US006488388B2

(12) United States Patent
Jones

(10) Patent No.: US 6,488,388 B2
(45) Date of Patent: Dec. 3, 2002

(54) LIGHT SOCKET UTILIZING A PHOTOCELL AND THREE-WAY SWITCH

(76) Inventor: Joseph Jones, 129 E. 95th St. Apt 2F, Brooklyn, NY (US) 11212

( * ) Notice: Subject to any disclaimer, the term of this patent is extended or adjusted under 35 U.S.C. 154(b) by 0 days.

(21) Appl. No.: 09/741,464

(22) Filed: Dec. 19, 2000

(65) Prior Publication Data

US 2002/0075676 A1 Jun. 20, 2002

(51) Int. Cl.[7] ..... G08B 13/18

(52) U.S. Cl. ..... 362/226; 362/276; 362/802; 362/395; 362/359; 362/391

(58) Field of Search ..... 362/226, 377, 362/378, 394, 404, 395, 802, 391, 359, 276; 315/32

(56) References Cited

U.S. PATENT DOCUMENTS

| | | | | | |
|---|---|---|---|---|---|
| 4,841,420 | A | | 6/1989 | Baggio et al. | 362/249 |
| 5,434,378 | A | * | 7/1995 | MsLean | 200/537 |
| 5,452,192 | A | | 9/1995 | Yurich | 362/346 |
| 5,510,970 | A | | 4/1996 | Hollenbach et al. | 362/396 |
| 5,637,964 | A | | 6/1997 | Hakkarainen et al. | 315/295 |
| 5,823,660 | A | | 10/1998 | Hsu | 362/276 |
| 5,867,099 | A | * | 2/1999 | Keeter | 340/567 |
| RE36,696 | E | * | 5/2000 | Blackman | 362/20 |
| 6,082,877 | A | * | 7/2000 | Hughes | 362/360 |
| 6,294,873 | B1 | * | 9/2001 | Yu | 315/149 |
| 6,390,647 | B1 | * | 5/2002 | Shaefer | 362/276 |

* cited by examiner

*Primary Examiner*—Stephen Husar
*Assistant Examiner*—Anabel Ton
(74) *Attorney, Agent, or Firm*—Goldstein & Lavas, P.C.

(57) ABSTRACT

A light socket utilizing a photocell and three-way switch including a cylindrical housing having an upper end, a lower end, and a cylindrical side wall therebetween. The upper end is couplable with a power source. The lower end has a light receiving socket disposed therein. The light receiving socket is adapted for receiving a light bulb therein. A frustoconical shield is secured to the cylindrical housing. The shield has a narrow open upper end and a wide open lower end. The narrow open upper end is secured to the lower end of the cylindrical housing. The wide open lower end is dimensioned to prevent the light bulb from directing light upwardly toward the cylindrical housing. A light activated switch is disposed within the cylindrical side wall of the cylindrical housing. The light activated switch is in communication with the light receiving socket whereby detection of ambient light will allow the light receiving socket to power the light bulb positioned therein. A three-way switch is disposed within the cylindrical side wall of the cylindrical housing. The three-way switch is in communication with the light receiving socket and the light activated switch.

4 Claims, 2 Drawing Sheets

LIGHT SOCKET UTILIZING A PHOTOCELL AND THREE-WAY SWITCH

BACKGROUND OF THE INVENTION

The present invention relates to a light socket utilizing a photocell and three-way switch and more particularly pertains to allowing a light to be activated by a number of different mechanisms.

Lighting systems utilized in construction sites are characterized as being "pigtail" like. These lights include a length of cable, commonly referred to as a common messenger wire, having splices, or power feed wires, along it's length allowing for the attachment of lights thereto to provide illumination at any interval along the length of cable. These lights are temporary, allowing for their easy removal. The importance of lights used in the construction industry is for their activation during the daytime hours when laborers are at work, and deactivated during the nighttime when the laborers are not at work. The use of a photocell is desirable to activate the lights when detecting light and deactivating the lights when there is no ambient light detected. This is generally opposite that of the standard use of photocells, wherein the light is activated when the photocell detects a lack of ambient light.

The use of lighting devices is known in the prior art. More specifically, lighting devices heretofore devised and utilized for the purpose of providing light are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,510,970 to Hollenbach et al. discloses a lamp for providing a work lamp on a temporary or semi-permanent basis at a work site. U.S. Pat. No. 5,823,660 to Hsu discloses an automatic lighting control device for a decorative light string. U.S. Pat. No. 5,452,192 to Yurich discloses a luminaire having hard wiring. U.S. Pat. No. 4,841,420 to Baggio et al. discloses string lights for construction sights. U.S. Pat. No. 5,637,964 to Hakkarainen et al. discloses a remote control system for individual control of spaced lighting fixtures.

While these devices fulfill their respective, particular objective and requirements, the aforementioned patents do not describe a light socket utilizing a photocell and three-way switch for allowing a light to be activated by a number of different mechanisms.

In this respect, the light socket utilizing a photocell and three-way switch according to the present invention substantially departs from the conventional concepts and designs of the prior art, and in doing so provides an apparatus primarily developed for the purpose of allowing a light to be activated by a number of different mechanisms.

Therefore, it can be appreciated that there exists a continuing need for a new and improved light socket utilizing a photocell and three-way switch which can be used for allowing a light to be activated by a number of different mechanisms. In this regard, the present invention substantially fulfills this need.

SUMMARY OF THE INVENTION

In the view of the foregoing disadvantages inherent in the known types of lighting devices now present in the prior art, the present invention provides an improved light socket utilizing a photocell and three-way switch. As such, the general purpose of the present invention, which will be described subsequently in greater detail, is to provide a new and improved light socket utilizing a photocell and three-way switch which has all the advantages of the prior art and none of the disadvantages.

To attain this, the present invention essentially comprises a common messenger wire couplable with a power source. The messenger wire includes a plurality of pairs of power wire feeds along a length thereof. A cylindrical housing is provided having an upper end, a lower end, and a cylindrical side wall therebetween. The upper end has a pair of wires extending outwardly thereof for coupling with a pair of the power wire feeds of the common messenger wire. The lower end has a light receiving socket disposed therein in communication with the pair of wires. The light receiving socket is adapted for receiving a light bulb therein. A frustoconical shield is secured to the cylindrical housing. The shield has a narrow open upper end and a wide open lower end. The narrow open upper end is secured to the lower end of the cylindrical housing. The wide open lower end is dimensioned to prevent the light bulb from directing light upwardly toward the cylindrical housing. A light activated switch is disposed within the cylindrical side wall of the cylindrical housing. The light activated switch is in communication with the light receiving socket whereby detection of ambient light will allow the light receiving socket to power the light bulb positioned therein. A three-way switch is disposed within the cylindrical side wall of the cylindrical housing. The three-way switch is in communication with the light receiving socket and the light activated switch. The three-way switch has a first position allowing power from the power source to be directed to the light receiving socket. The three-way switch has a second position preventing power from being directed to the light receiving socket. The three-way switch has a third position enabling the light activated switch.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved light socket utilizing a photocell and three-way switch which has all the advantages of the prior art lighting devices and none of the disadvantages.

It is another object of the present invention to provide a new and improved light socket utilizing a photocell and three-way switch which may be easily and efficiently manufactured and marketed.

It is a further object of the present invention to provide a new and improved light socket utilizing a photocell and three-way switch which is of durable and reliable construction.

An even further object of the present invention is to provide a new and improved light socket utilizing a photocell and three-way switch which is susceptible of a low cost of manufacture with regard to both materials and labor, and which accordingly is then susceptible of low prices of sale to the consuming public, thereby making such a light socket utilizing a photocell and three-way switch economically available to the buying public.

Even still another object of the present invention is to provide a new and improved light socket utilizing a photocell and three-way switch for allowing a light to be activated by a number of different mechanisms.

Lastly, it is an object of the present invention to provide a new and improved light socket utilizing a photocell and three-way switch including a cylindrical housing having an upper end, a lower end, and a cylindrical side wall therebetween. The upper end is couplable with a power source. The lower end has a light receiving socket disposed therein. The light receiving socket is adapted for receiving a light bulb therein. A frustoconical shield is secured to the cylindrical housing. The shield has a narrow open upper end and a wide open lower end. The narrow open upper end is secured to the lower end of the cylindrical housing. The wide open lower end is dimensioned to prevent the light bulb from directing light upwardly toward the cylindrical housing. A light activated switch is disposed within the cylindrical side wall of the cylindrical housing. The light activated switch is in communication with the light receiving socket whereby detection of ambient light will allow the light receiving socket to power the light bulb positioned therein. A three-way switch is disposed within the cylindrical side wall of the cylindrical housing. The three-way switch is in communication with the light receiving socket and the light activated switch.

The three-way switch has a first position allowing power from the power source to be directed to the light receiving socket. The three-way switch has a second position preventing power from being directed to the light receiving socket. The three-way switch has a third position enabling the light activated switch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
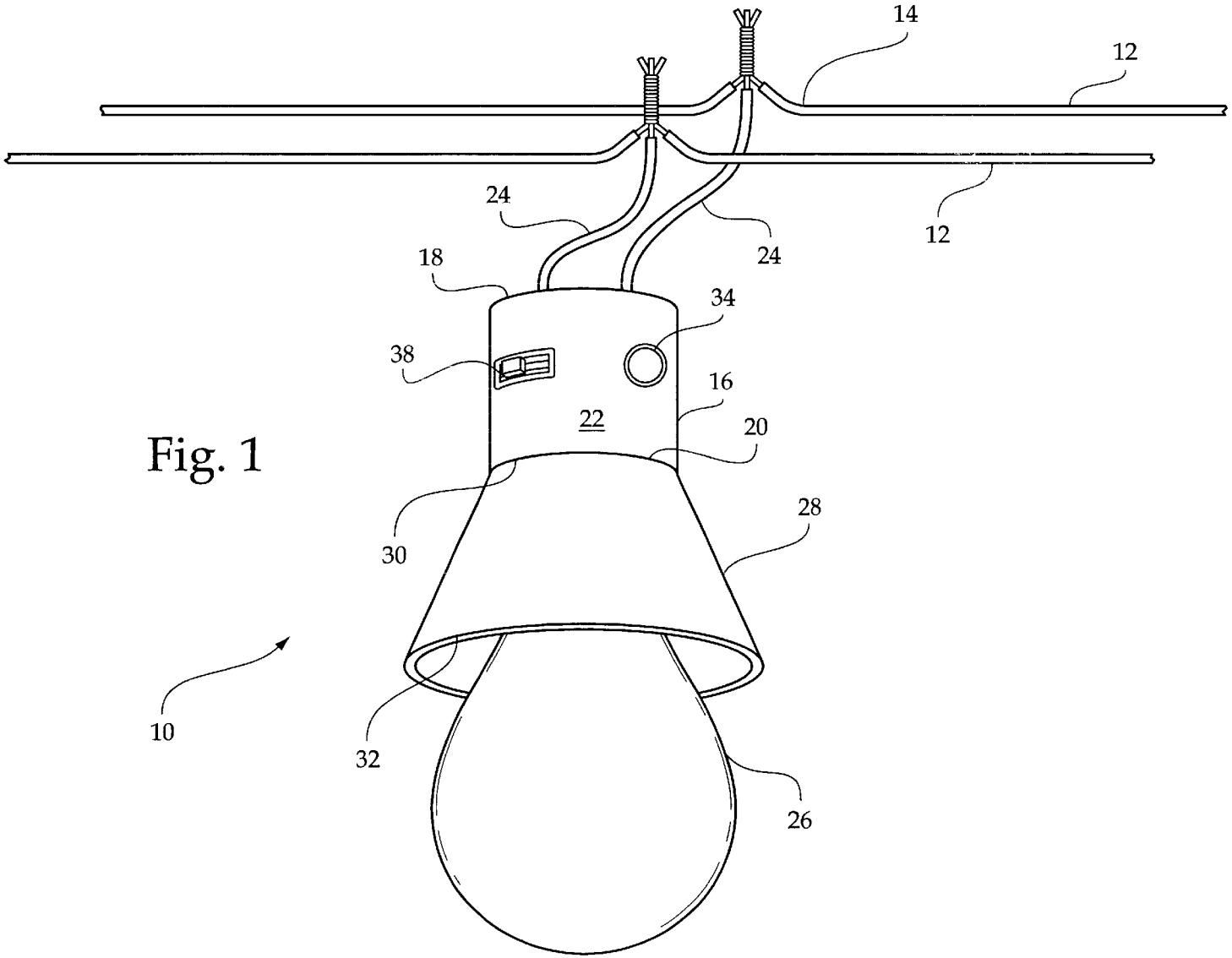
FIG. 1 is a perspective view of the preferred embodiment of the light socket utilizing a photocell and three-way switch constructed in accordance with the principles of the present invention.
Figure 3:
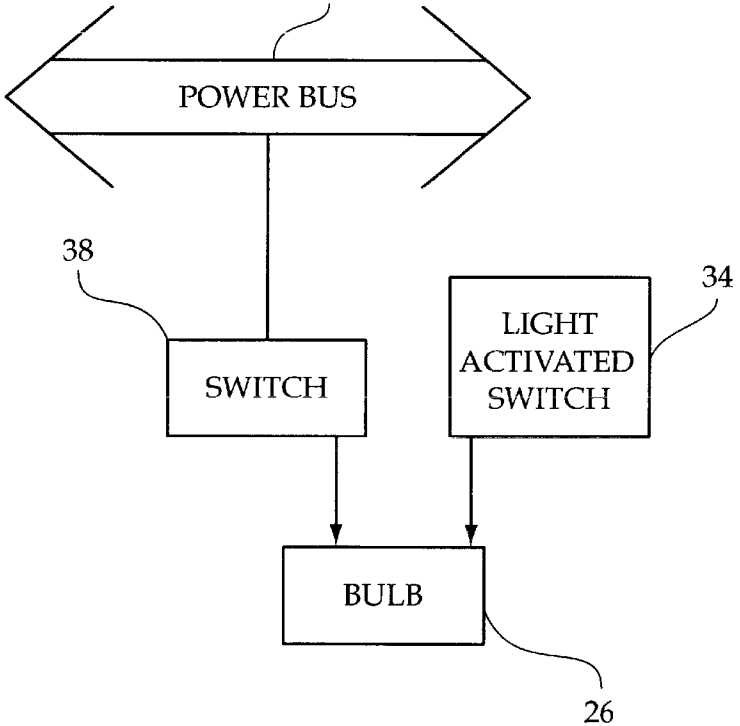
FIG. 3 is a schematic illustration of the operation of the present invention.
Figure 2:
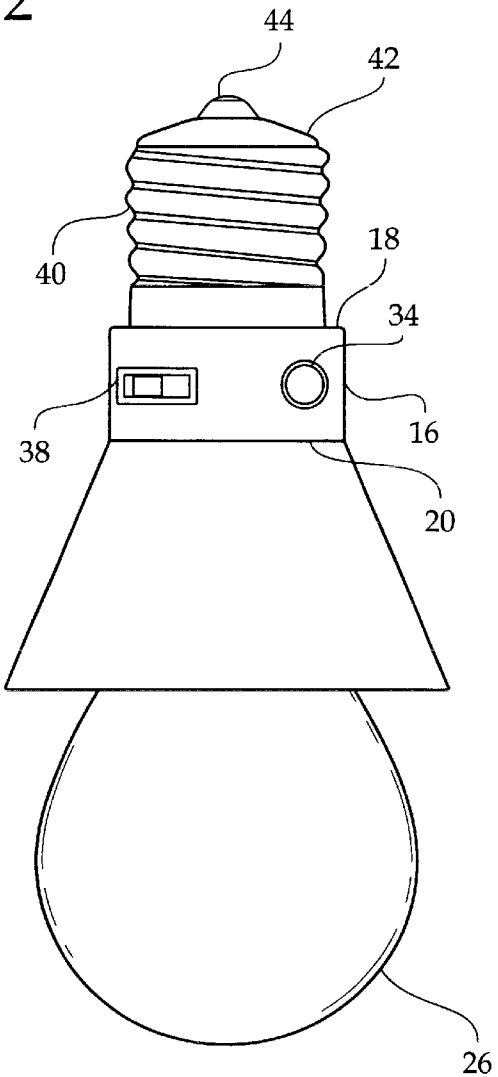
FIG. 2 is a front view of an alternate design of the present invention.

With reference now to the drawings, and in particular, to FIGS. 1 through 3 thereof, the preferred embodiment of the new and improved light socket utilizing a photocell and three-way switch embodying the principles and concepts of the present invention and generally designated by the reference number 10 will be described.

Specifically, it will be noted in the various figures that the device relates to a light socket utilizing a photocell and three-way switch for allowing a light to be activated by a number of different mechanisms. In its broadest context, the device works in conjunction with a common messenger wire, and comprises a cylindrical housing, a frustoconical shield, a light activated switch, and a three-way switch. Such components are individually configured and correlated with respect to each other so as to attain the desired objective.

The common messenger wire 12 is couplable with a power source and extends horizontally. The messenger wire 12 includes a plurality of pairs of power wire feeds 14 along a length thereof. Note FIG. 1.

"The cylindrical housing 16 has an upper end 18, a lower end 20, and a cylindrical side wall 22 therebetween. The upper end 18 has a pair of wires 24 extending outwardly thereof for coupling with a pair of the power wire feeds 14 of the common messenger wire 12. The cyclindrical housing 16 is suspended from the messenger wire 12. The lower end 20 has a light receiving socket disposed therein in communicatiion with the pair of wires 24. The light receiving socket is adapted for ececiving a light bulb 26 therein."

The frustoconical shield 28 is secured to the cylindrical housing 16. The shield 28 has a narrow open upper end 30 and a wide open lower end 32. The narrow open upper end 30 is secured to the lower end 20 of the cylindrical housing 16. The wide open lower end 32 is dimensioned to prevent the light bulb 26 from directing light upwardly toward the cylindrical housing 16.

The wide open lower end 32 is wide enough to accommodate the light bulb 26 as well as prevent the light generated to be blocked from shining upwardly toward the cylindrical housing 16.

The light activated switch 34 is disposed within the cylindrical side wall 22 of the cylindrical housing 16. The light activated switch 34 is in communication with the light receiving socket whereby detection of ambient light will allow the light receiving socket to power the light bulb 26 positioned therein.

The light activated switch 34 will only cause the activation of the light bulb 26 when ambient light is detected. Thus, the light bulb 26 can only be activated in the light of day when the light activated switch 34 is being used.

The three-way switch 38 is disposed within the cylindrical side wall 22 of the cylindrical housing 16. The three-way switch 38 is in communication with the light receiving socket and the light activated switch 34. The three-way switch 38 has a first position allowing power from the power source to be directed to the light receiving socket. The three-way switch 38 has a second position preventing power from being directed to the light receiving socket. The three-way switch 38 has a third position enabling the light activated switch 34. Thus, the three-way switch 38 can activate the light bulb 26 manually, deactivate the light bulb 26 manually, or allow the light activated switch 34 to automatically control the light bulb 26.

A second embodiment of the present invention is shown in FIG. 2 and includes substantially all of the components of the present invention wherein the device 10 is adapted for use with a standard light socket instead of use with the common messenger wire as described in the preferred embodiment. In this embodiment, the upper end 18 of the cylindrical housing 16 is provided with a ring contact 40, insulator 42, and tip contact 44 to allow for screw-in coupling with a standard light socket.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A light socket utilizing a photocell and three-way switch for allowing a light bulb to be activated by a number of different mechanisms comprising, in combination:

a common messenger wire couplable with a power source, the messenger wire extending horizontally and including a plurality of pairs of power wire feeds along a length thereof;

a cylindrical housing having an upper end, a lower end, and a cylindrical side wall therebetween, the upper end having a pair of wires extending outwardly thereof for coupling with a pair of the power wire feeds of the common messenger wire and for suspending the cyclindrical housing from the common messenger wire, the lower end having a light receiving socket disposed therein in communication with the pair of wires, the light receiving socket being adapted for receiving the light bulb therein;

a frustoconical shield secured to the cylindrical housing, the shield having a narrow open upper end and a wide open lower end, the narrow open upper end being secured to the lower end of the cylindrical housing, the wide open lower end being dimensioned to prevent the light bulb from directing light upwardly toward the cylindrical housing;

a light activated switch disposed within the cylindrical side wall of the cylindrical housing, the light activated switch being in communication with the light receiving socket whereby detection of ambient light will allow the light receiving socket to power the light bulb positioned therein; and a three-way switch disposed within the cylindrical side wall of the cylindrical housing, the three-way switch being in communication with the light receiving socket and the light activated switch, the three-way switch having a first position allowing power from the power source to be directed to the light receiving socket, the three-way switch having a second position preventing power from being directed to the light receiving socket, the three-way switch having a third position enabling the light activated switch.

2. A light socket allowing a light bulb to be activated comprising, in combination:

a cylindrical housing having an upper end, a lower end, and a cylindrical side wall therebetween, the upper end being couplable with a power source, the lower end having a light receiving socket disposed therein, the light receiving socket being adapted for receiving the light bulb therein;

a shield secured to the cylindrical housing, the shield having a narrow open upper end and a wide open lower end, the narrow open upper end being secured to the lower end of the cylindrical housing, the wide open lower end being dimensioned to prevent the light bulb from directing light upwardly toward the cylindrical housing;

a light activated switch disposed within the cylindrical side wall of the cylindrical housing, the light activated switch being in communication with the light receiving socket whereby detection of ambient light will allow the light receiving socket to power the light bulb positioned therein.

3. The light socket as set forth in claim 2, further comprising a three-way switch disposed within the cylindrical side wall of the cylindrical housing, the three-way switch being in communication with the light receiving socket and the light activated switch, the three-way switch having a first position allowing power from the power source to be directed to the light receiving socket, the three-way switch having a second position preventing power from being directed to the light receiving socket, the three-way switch having a third position enabling the light activated switch.

4. The light as set forth in claim 3, wherein the upper end of the cylindrical housing is adapted for coupling with a standard electrical socket.

* * * * *